US008851156B2

(12) United States Patent
Semmes

(10) Patent No.: US 8,851,156 B2
(45) Date of Patent: Oct. 7, 2014

(54) HEAT EXCHANGER HEADER ASSEMBLY

(76) Inventor: Thomas Middleton Semmes, Gladstone, OR (US)

( * ) Notice: Subject to any disclaimer, the term of this patent is extended or adjusted under 35 U.S.C. 154(b) by 865 days.

(21) Appl. No.: 12/789,352

(22) Filed: May 27, 2010

(65) Prior Publication Data

US 2011/0290463 A1 Dec. 1, 2011

(51) Int. Cl.

| | |
|---|---|
| ***F28F 19/00*** | (2006.01) |
| ***F28D 1/04*** | (2006.01) |
| ***F28D 7/02*** | (2006.01) |
| ***F28D 1/053*** | (2006.01) |

(52) U.S. Cl.

CPC ..... *F28D 1/05316* (2013.01)

USPC ..... 165/134.1; 165/151; 165/165; 165/164

(58) Field of Classification Search

USPC ..... 165/164, 151, 165, 134.1, DIG. 222, 165/9.1, 9.3, 173, 174, 175; 138/32, 38, 138/115, 116

See application file for complete search history.

(56) References Cited

U.S. PATENT DOCUMENTS 5,690,166 A * 11/1997 Yamaguchi ..... 165/96
2004/0129267 A1* 7/2004 Bourne et al. ..... 126/634

FOREIGN PATENT DOCUMENTS

GB 2078362 A * 1/1982
SU 1177638 A * 9/1985

OTHER PUBLICATIONS

SU 1177638 A english abstract.*
SU 1177638 A english abstract Sep. 7, 1984.*

* cited by examiner

*Primary Examiner* — Judy Swann
*Assistant Examiner* — Jon T Schermerhorn
(74) *Attorney, Agent, or Firm* — Mark S. Hubert

(57) ABSTRACT

A freeze protection system to repeatedly protect the coils or tubes of a heat exchanger/radiator that does not require any maintenance after the contained fluid in the heat exchanger/radiator has experienced a freeze. The system lends itself to construction as a repeatable grouping of diversely different geometric shapes that can then be used to build a freeze protection system for a plethora of sizes of heat exchangers/radiators or, can be made into a unitary, monolithic sheet for a specific sized heat exchanger.

8 Claims, 11 Drawing Sheets

HEAT EXCHANGER HEADER ASSEMBLY

BACKGROUND OF THE INVENTION

The present invention relates to a system that will prevent the damage of a heat exchanger/radiator (Hx) when the fluid contained within the coils or tubes freezes. Unlike the current state of the art Hx freeze protection systems, which have replaceable burst caps located on each of the tube U bend ends in the Hx air tunnel space of the header, this system can withstand repeated freezings.

This new system fulfills a long felt need in the HVAC field as the inadvertent freezing of the heat transfer media fluid in the Hx no longer renders the Hx unusable until the header is dismantled and the fluid replaced and the system properly vented. Rather, such freezings can occur and correct themselves, without damage to the Hx.

Additionally, the design of the present heat exchanger header assembly offers a reduction in the air tunnel space enclosed within the header that the coil/tube U bends reside in.

This new invention utilizes and combines known and new technologies in a unique and novel geometric configuration to render a more compact and freeze resistant heat exchanger.

SUMMARY OF THE INVENTION

The general purpose of the present invention, which will be described subsequently in greater detail, is to provide a new freeze protection system for a radiator/heat exchanger that requires no human attendance, maintenance or repair, and is able to cope with multiple freezings of the contained fluid.

It has many of the advantages mentioned heretofore and many novel features that result in a new radiator freeze protection system which is not anticipated, rendered obvious, suggested, or even implied by any of the prior art, either alone or in any combination thereof.

In accordance with the invention, an object of the present invention is to provide an improved radiator header freeze protection system capable of preventing damage to the tubes or header caps of a radiator in the event the contained fluid freezes.

It is another object of this invention to provide an improved radiator freeze protection system that requires no replacement of components or heat transfer media fluid after a freeze has occurred in a tube.

It is a further object of this invention to provide an improved radiator that may be constructed as geometric groupings or patterns of diversely shaped elements that can be used for a multitude of different sized radiators or as a unitary block for a specific sized radiator.

It is a another object of the present invention to provide an improved heat exchanger header that is more compact than those of the conventional headers and that can be physically reconfigured to change the flow paths between the tubes in the event of a tube rupture.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
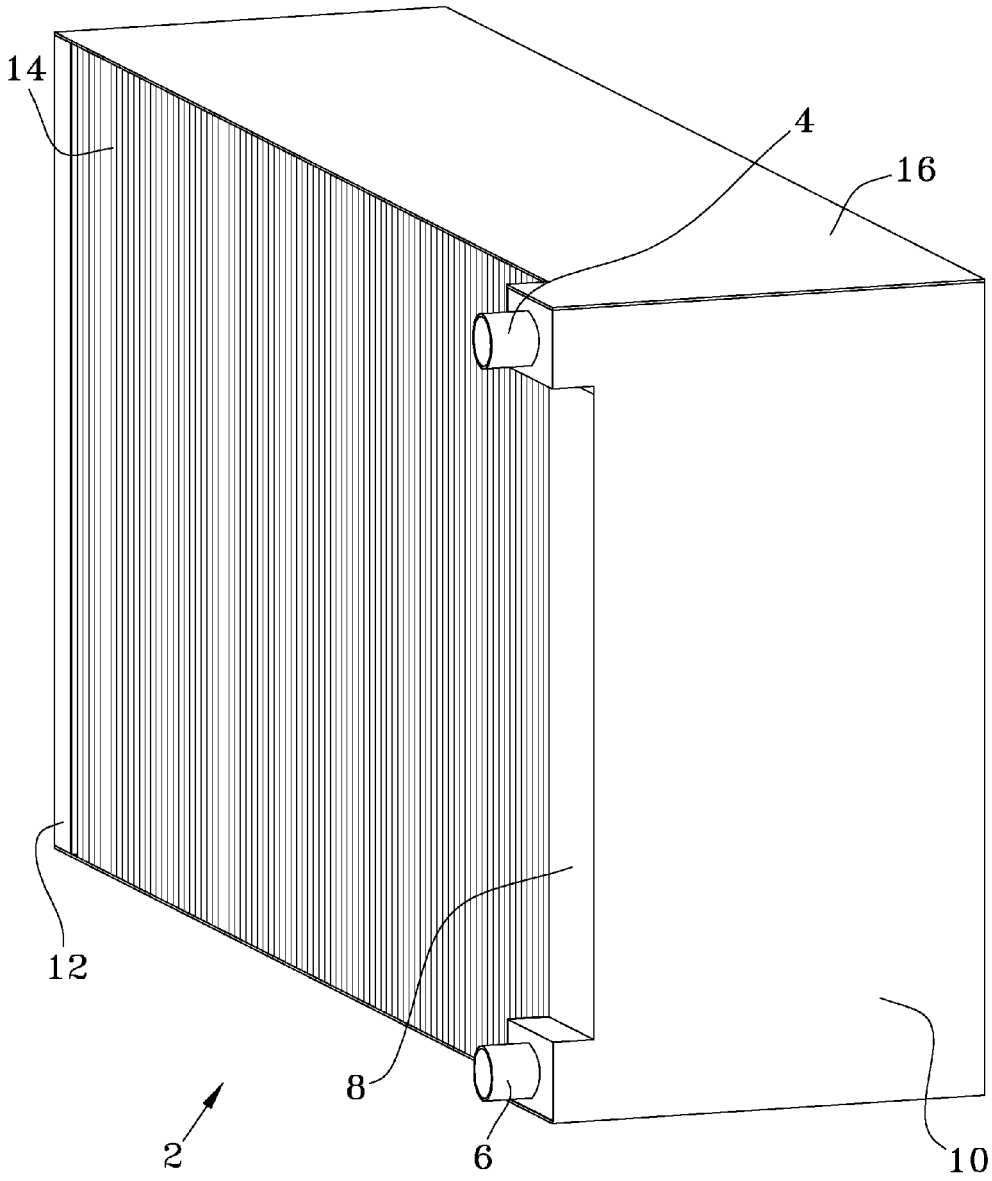
FIG. 1 is a front perspective view of the improved header assembly on a heat exchanger.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. For example, the term heat exchanger refers to any of a plethora of devices wherein a primary heat transfer fluid is circulated through a coil/s or tube/s (hereinafter tubes) that are in contact with a secondary heat transfer medium such as air. For the purposes of this invention, it does not matter what the specific application of the Hx is, rather just the configuration of the tubes (size and spacing) and the header cross sectional shape. It has almost unlimited heat transfer applications.

The most common media used for heat transfer is water because of the reduced pumping and other costs involved compared to a more viscous, media. Often the primary heat transfer fluid contained in a heat exchanger may freeze if the secondary heat transfer medium's temperature drops, if the source of the heat going into the primary heat transfer fluid stops, or if the control system flow regulation malfunctions. When this happens if the primary heat transfer fluid is water (with an insufficient content of antifreeze) it may freeze and expand in the tubes. Since these tubes are generally linear the fluid freezes along its length without issue, but bursts the coils in the air tunnel space of the header between the heat exchanger support wall and the header endcaps where the coils make their sharp radius U bends before returning back to the other header. The prior art prevents the loss of the entire Hx by putting a freeze cap at the end of each coil in the heat exchanger radiator headers under the endcaps. These freeze caps are designed to rupture before the tubes to prevent the destruction of the entire Hx. The problem thereafter is that the primary heat transfer fluid is lost through the rupture and the freeze cap must be replaced, necessitating the removal of the end caps and possibly the header. The present invention alleviates this timely and costly repair.

Looking at FIG. 1 it can be seen that the exterior of a Hx 2 with the improved header assembly shows the inlet line 4 and outlet line 6 on the supply header 8 sealed by the end cap 10 and the thinner profile return header 12 on the opposite side of the Hx enclosure 16. The tube fins 14 can be seen extending from the front face of the Hx enclosure.

Figure 2:
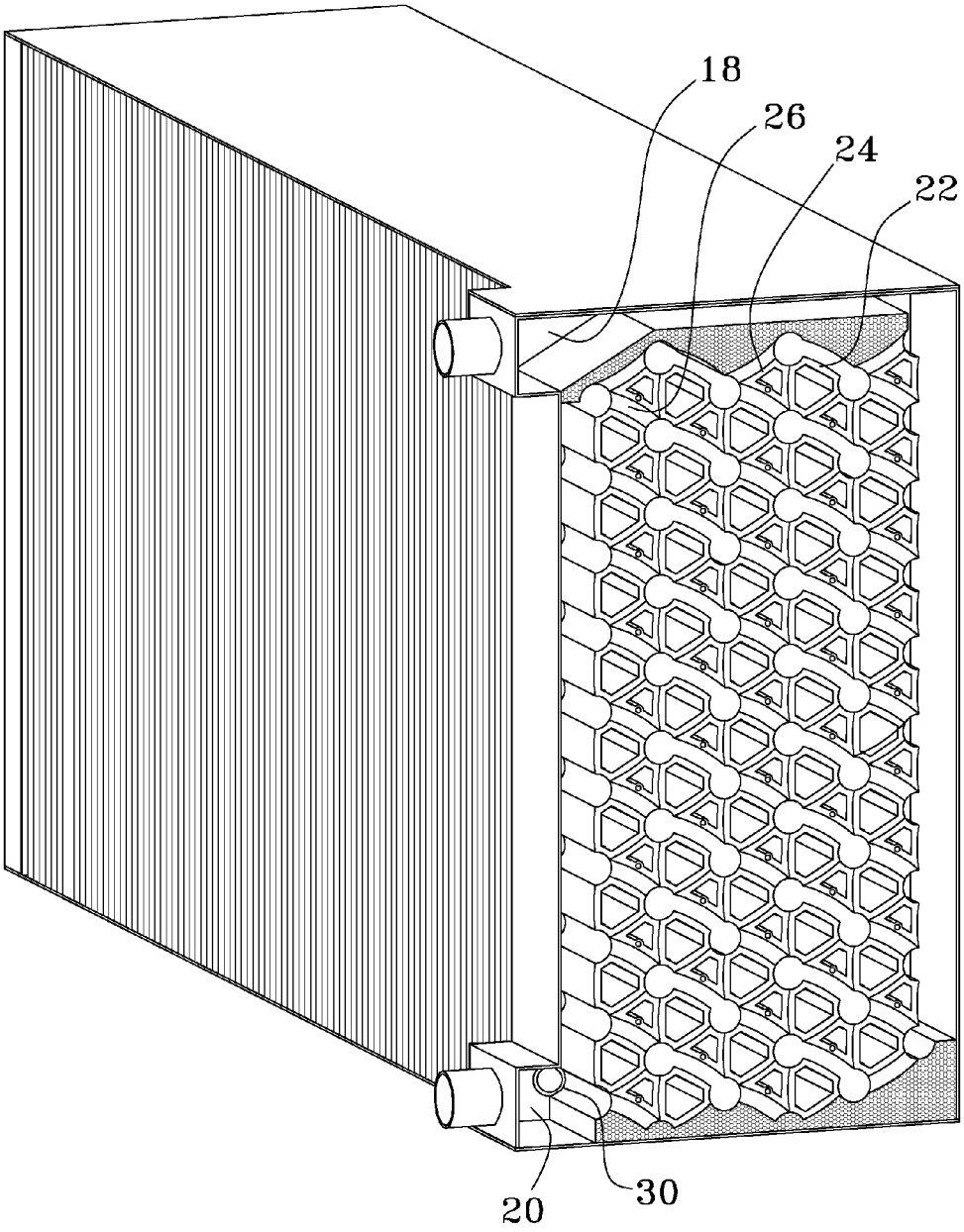
FIG. 2 is a front perspective view of the improved header assembly with the supply header side plate removed.
Figure 3:
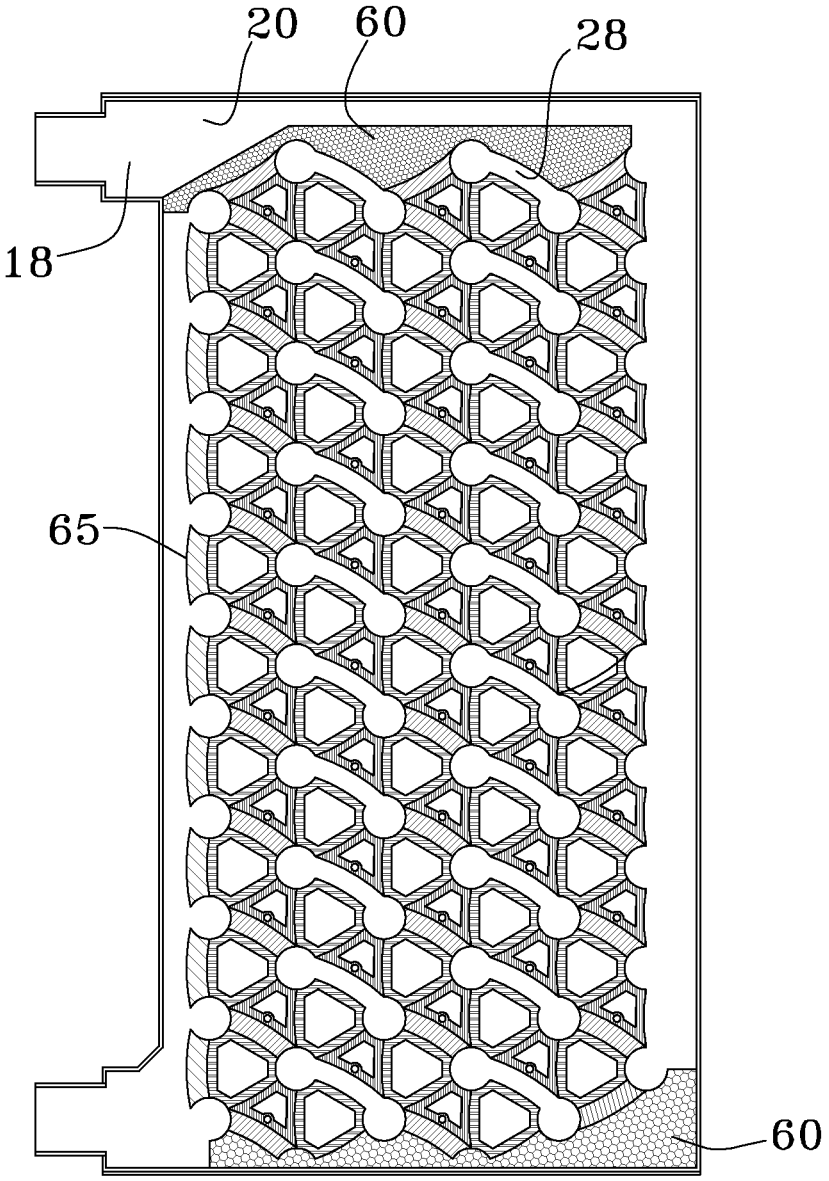
FIG. 3 is a side view of the improved supply header assembly's internal components.
Figure 5:
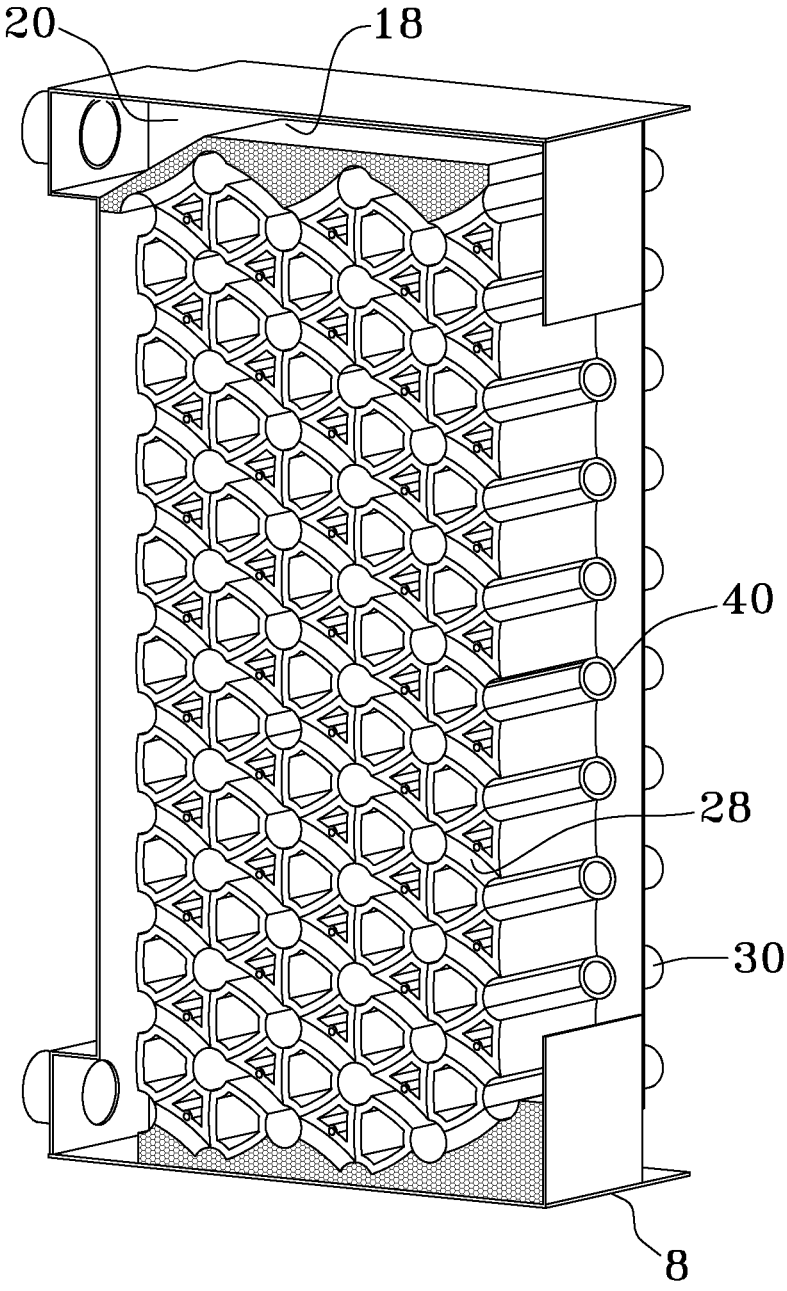
FIG. 5 is a side perspective view with a partial cutaway showing the general arrangement of the components of the improved supply header assembly.
Figure 16:
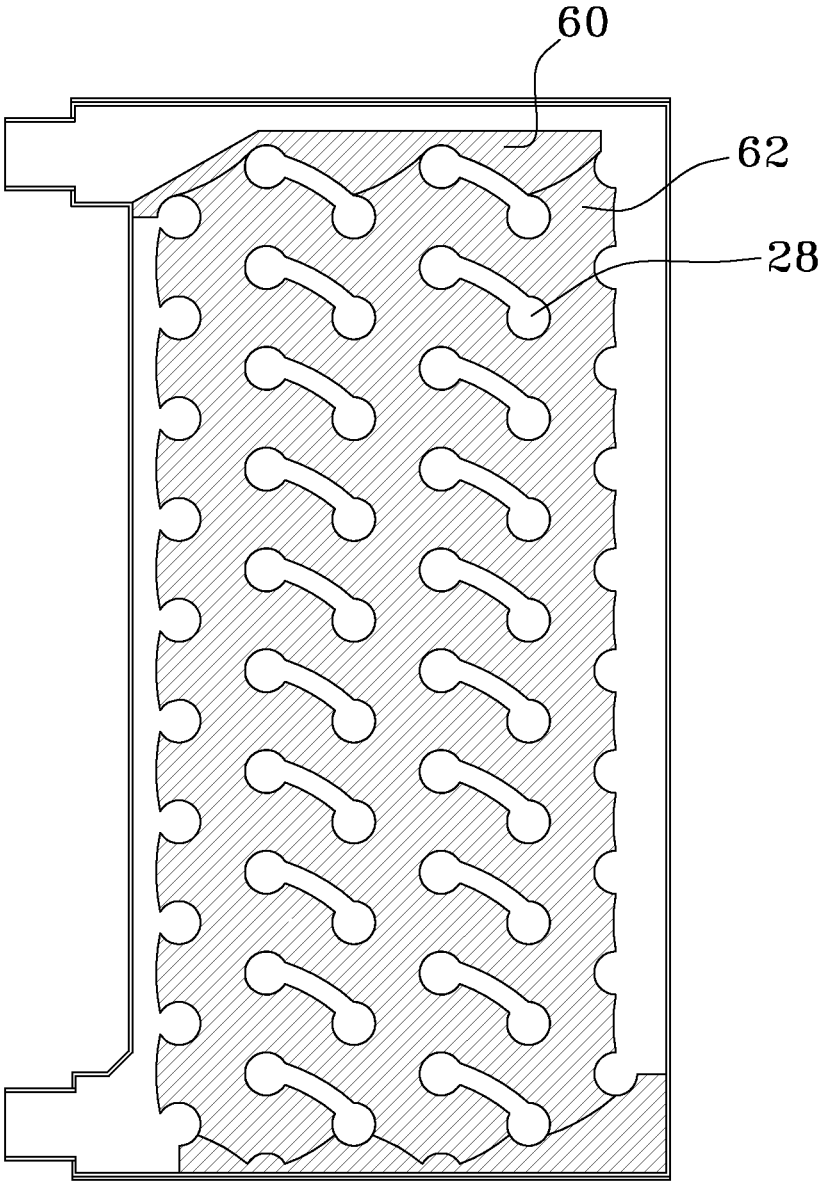
FIG. 16 is an end view of a unitary supply header channel sheet.
Figure 17:
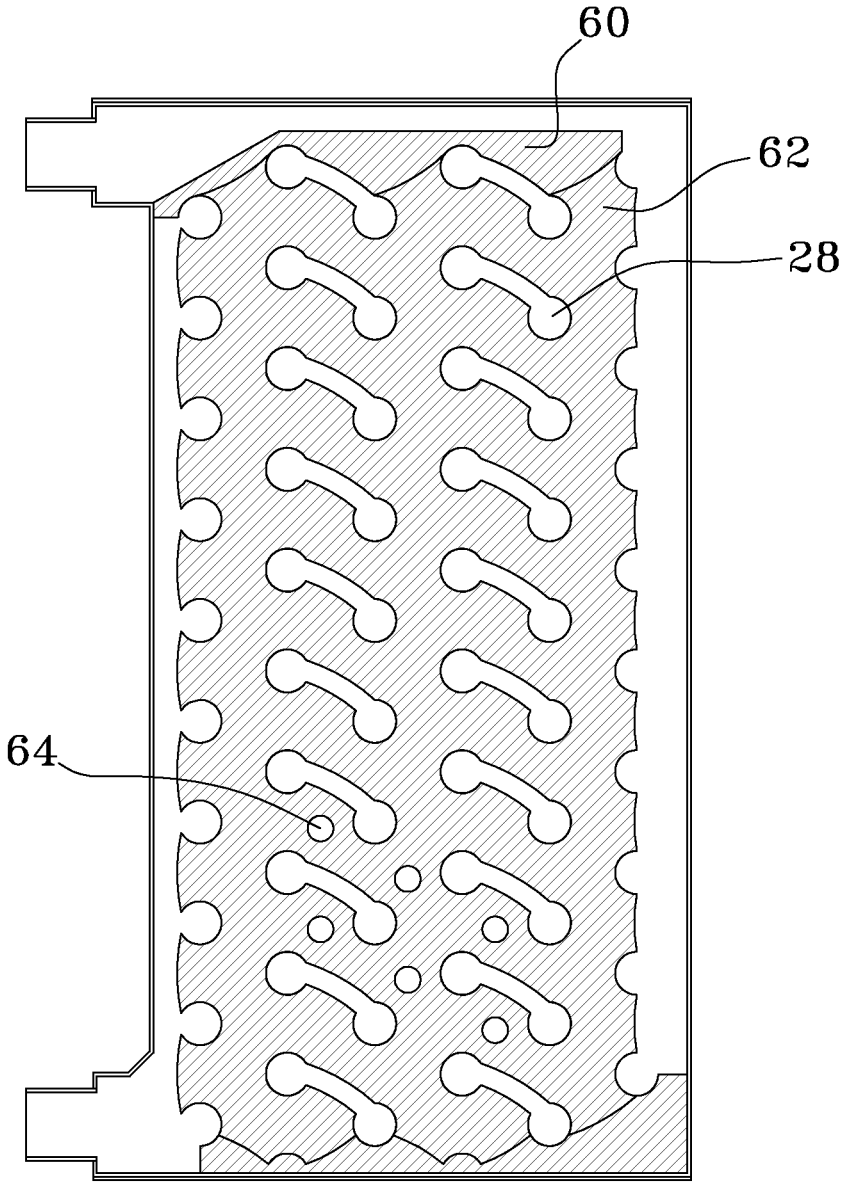
FIG. 17 is an end view of a unitary supply header channel sheet with interstitial voids.

Looking at FIGS. 2, 3 and 5 it can be seen that the present system allows for the elastic deformation of certain hollow freeze protection polymer supply cylinders 22, 24 and 26 placed in the header air tunnel space 18 between the heat exchanger support wall 20 and the header endcap 10 to accommodate the increase in volume of the freezing water. The three cylinders are geometrically shaped as hollow polygonal prisms so as to cooperatively interlock within the air tunnel space 18 so as to form fluid paths 28 between selected adjacent pairs of tubes 30 so that the heat transfer fluid can traverse the length of the Hx in one tube, traverse the fluid path in the air tunnel space 20 in one header and exit into another tube 30 to traverse the length of the Hx in the opposite direction. It is to be noted that the Hx tubes 30 extend slightly beyond the face of the Hx support plate 20 so as to make a lip 40 for the three cylinders to contact and center themselves against to establish their repeating pattern within the header. It is known that in other embodiments there is no need for the tubes 30 to extend to form lips 40 beyond the face of the support plate 20, especially where the cylinders have been conjoined to form a unitary freeze protection sheet (FIGS. 16 and 17).

Figure 4:
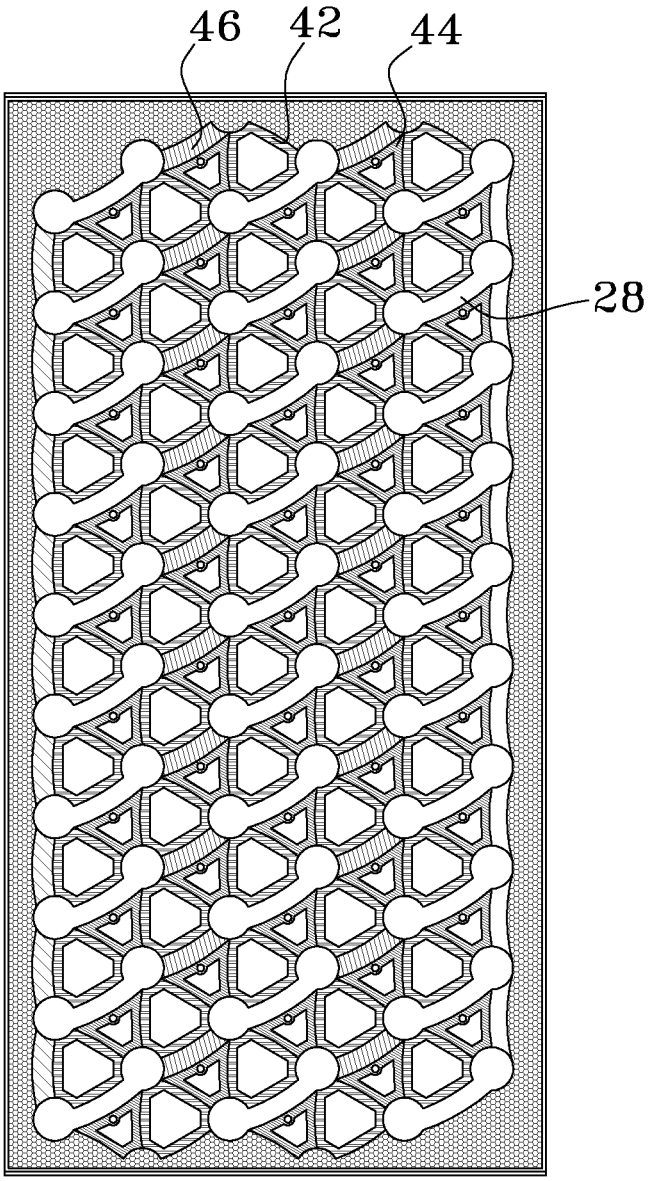
FIG. 4 is a side view of the improved return header assembly's internal components.
Figure 6:
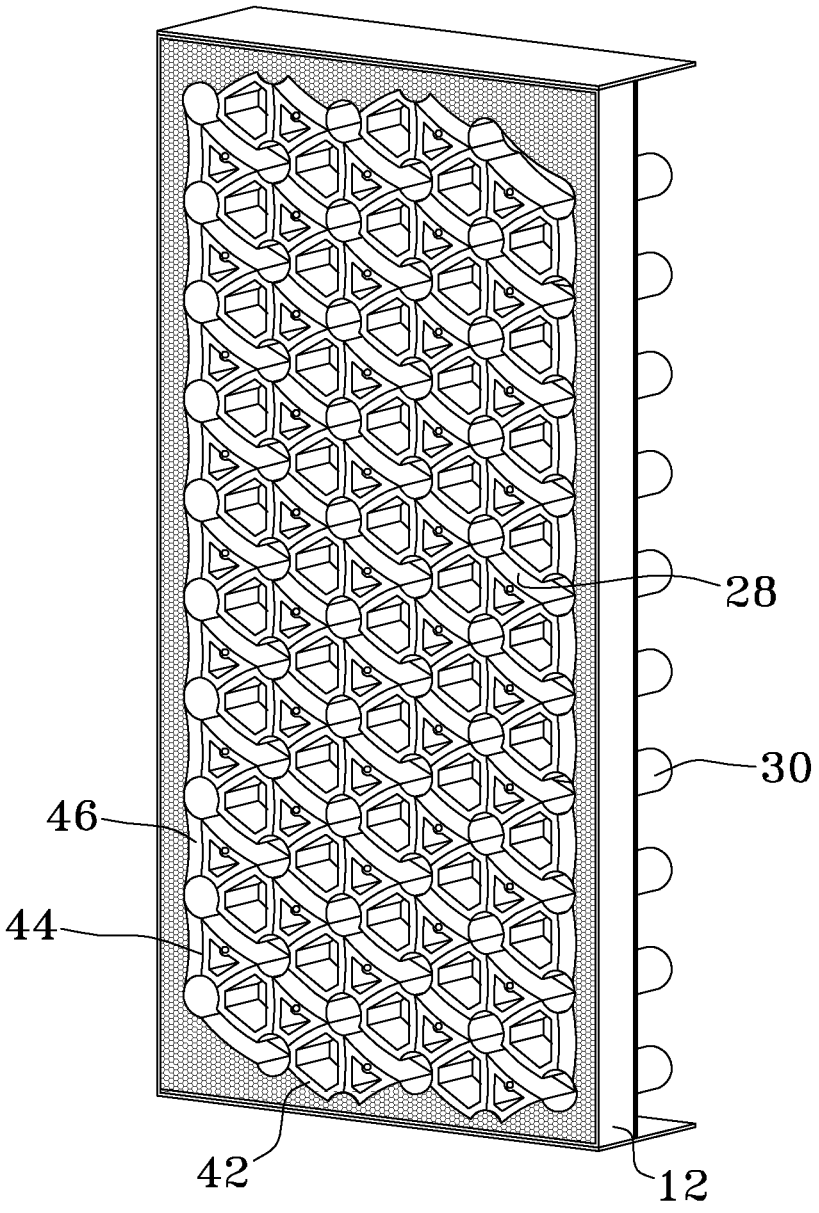
FIG. 6 is a side perspective view with a partial cutaway showing the general arrangement of the components of the improved return header assembly.

FIGS. 4 and 6 illustrate the internals of the return header 12 at the opposite end of the Hx 2. Here it can be seen that the same shaped hollow polygonal prism (referred to as cylinders) are used to establish the fluid paths 28 between the tubes 30 within the return header 12, however since the return header is slimmer than the supply header 8, the return cylinders 42, 44, and 46 have a shorter length body than supply cylinders 22, 24 and 26.

Figure 7:
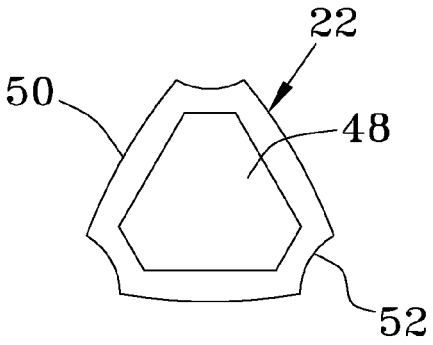
FIG. 7 is an end view of the return and supply header freeze plugs.
Figure 8:
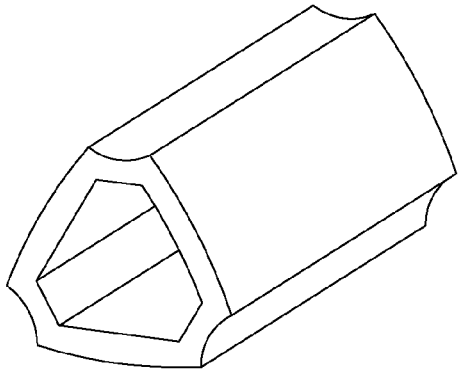
FIG. 8 is a side perspective view of the supply header freeze plug.
Figure 9:
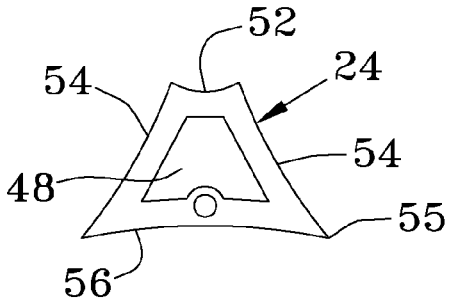
FIG. 9 is an end view of the return and supply header central diverter.
Figure 10:
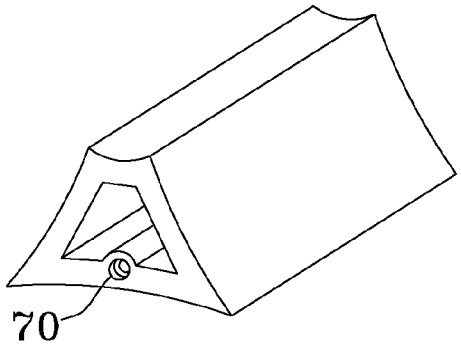
FIG. 10 is a side perspective view of the supply header central diverter.
Figure 11:
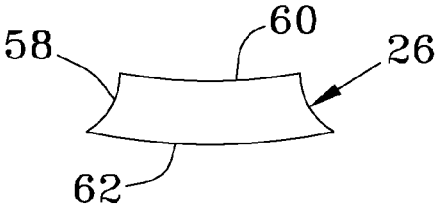
FIG. 11 is an end view of the supply and return header edge diverter.
Figure 12:
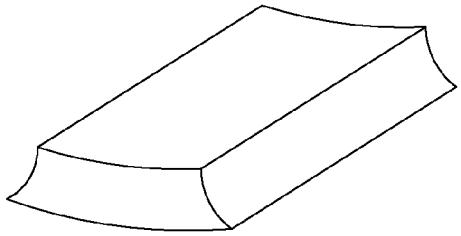
FIG. 12 is a side perspective view of the supply header edge diverter.
Figure 13:
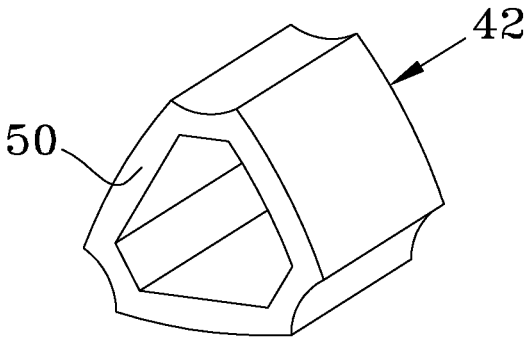
FIG. 13 is a side perspective view of the return header freeze plug.
Figure 14:
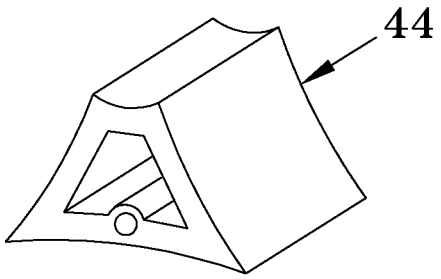
FIG. 14 is a side perspective view of the return header central divider.
Figure 15:
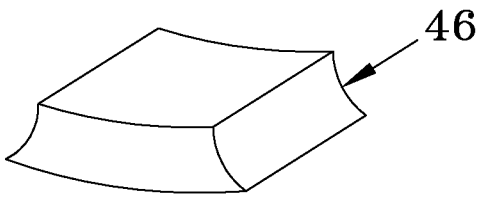
FIG. 15 is a side perspective view of the return header edge diverter.

Looking at FIGS. 7 to 15 the geometric configuration of the three supply header cylinders 22, 24 and 26 as well as return header cylinders 42, 44 and 46 can be seen. The difference between these two sets of cylinders is only the depth of length of each set of cylinders. Although the illustrated embodiment shows a return header that is thinner than the supply header, this is done to show how the use of the improved header assembly can minimize the size of the Hx 2. If size is not a concern then the same cylinders may be used in both the supply and return headers and the headers sized identically. While FIGS. 8, 10 and 12 show the supply header cylinders 22, 24 and 26 and FIGS. 13, 14 and 15 show the return header cylinders 42, 44, and 46 it is to be noted that FIGS. 7, 9 and 11 show the cross sectional profiles common to one cylinder in each set.

The supply header freeze plug cylinder 22 and the return header freeze plug cylinder 42 each have an internal void 48 with six interior walls and six exterior walls. The internal void 48 allows the cylinder walls to flex inward to compensate for the expanse in volume when a freeze of the heat transfer media occurs in the header. Additionally the remaining cylinders can deform slightly to absorb this expanse in volume and maintain their seals with their adjacent cylinders. The interior void configuration is only an aesthetic preference in any of the cylinders and a simple circular void would suffice. As such, the six interior walls of the freeze plug cylinders and the central diverter cylinders is not relevant and will not be detailed herein. The relevant physical limitation on this inward flex is the thickness between the cylinder's outer wall and inner wall. This may be adjusted accordingly although in the preferred embodiment this thickness is approximately ¼ tube outside diameter. The exterior wall configuration however, of all cylinders is very relevant. It is based on a staggered tube design wherein all adjacent tubes 30 are equidistant, tube center to tube center. Headers with different tube diameters and spacings will need different sized cylinders, however the geometric configuration of the cylinders disclosed herein will work with all staggered tube design Hx's. A generic formula is disclosed herein that describes the arcs and lengths of each of the exterior walls of the three cylinders.

Supply and return header freeze plug cylinders 22 and 42 have six exterior walls made up of three substantially similar convex curved exterior walls 50 having the same radius wherein each curved exterior wall 50 is separated from the other two by a smaller radius curved wall 52 (having the exterior radius of the tubes.) It also has six interior walls defining an interior void 48 that allows the cylinder walls to flex inward to compensate for the expanse in volume when a freeze of the heat transfer media occurs in the header.

The supply header central diverter cylinder 24 and the return header central diverter cylinder 44 each have an internal void 48 with four interior walls and four exterior walls. The internal void 48 allows the cylinder walls to flex inward to compensate for the expanse in volume when a freeze of the heat transfer media occurs in the header. Supply and return header central diverter cylinders 24 and 44 have four concave curved exterior walls. Two of these shorter, substantially similar length concave curved exterior walls 54 are connected an one end by smaller radius curved wall 52 (having the radius of the tubes) and at their other ends by a longer concave exterior wall 56 to form apexes 55. The concave exterior walls 54 have a smaller radius than does the longer concave exterior wall 56. There is an optional mounting orifice 70 extending along these cylinders that allows for the use of an optional mechanical mounting means (not illustrated) whether it be a pin, screw, bolt or equivalent fastener as is well known in the art.

The supply header edge diverter cylinder 26 and the return header edge diverter cylinder 46 each have four curved sides. Three of these sides are concave and the other is convex. The two substantially similar short convex sides 58 have the radius of the tubes. The remaining short concave side 60 and the long convex side 62 reside parallel to each other and are separated by the distance of the radius of the tubes. The short concave side 60 has the same radius of the curved exterior walls 50 of freeze plug cylinders 22 and 42 which is the same as the radius of the two concave curved exterior walls 54 of the central diverter cylinders 24 and 44. The long convex side 62 has the same radius of the longer concave exterior wall 56 of central diverter cylinders 24 and 44. The centers of the circles having the radiuses that define the arcs of these short and long convex sides are common.

Figure 19:
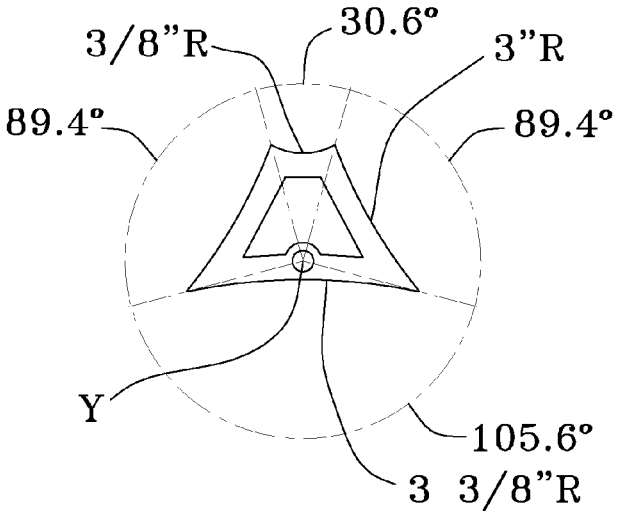
FIG. 19 is an end view of the central diverter showing the geometric configuration necessary for the fluid sealing of a ¾ inch diameter staggered tube heat exchanger with the centers of adjacent tubes 1¾ inches apart.
Figure 18:
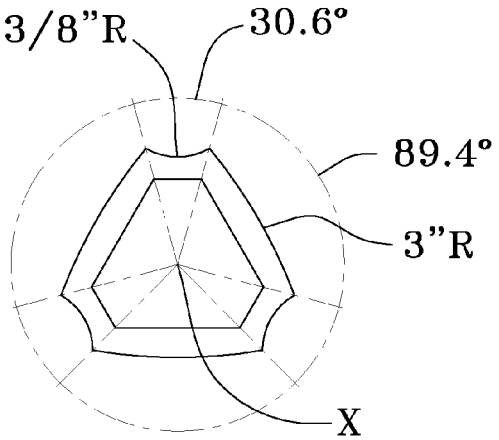
FIG. 18 is an end view of the freeze plug showing the geometric configuration necessary for the fluid sealing of a ¾ inch diameter staggered tube heat exchanger with the centers of adjacent tubes 1¾ inches apart.
Figure 20:
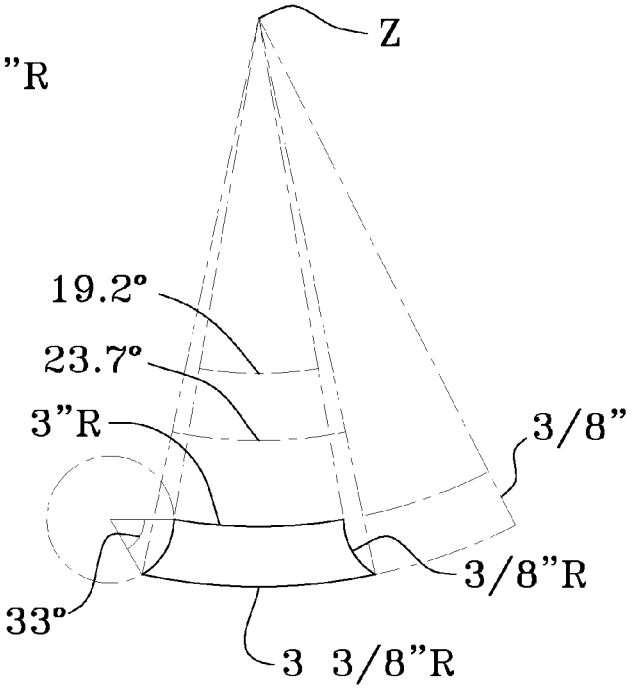
FIG. 20 is an end view of the edge diverter showing the geometric configuration necessary for the fluid sealing of a ¾ inch diameter staggered tube heat exchanger with the centers of adjacent tubes 1¾ inches apart.

Looking at FIGS. 18-20 all the dimensions for the arc radius and arc length of the various walls are illustrated for a header design using a ¾ inch diameter tube 30 that has its midpoint at & 1¾ inches from the midpoint of all adjacent tubes, and which has 1 inch of space between the closest points of adjacent exterior tube walls.

The following table represents the contour (arc) and length of each of the walls of the three cylinders for a ¾ inch diameter staggered tube heat exchanger with the centers of adjacent tubes 1¾ inches apart. The freeze plug cylinder is described in terms of the centroid X of its two dimensional cross sectional shape. The central diverter cylinder is described in terms of the circumcenter Y of a circumscribing circle drawn about its two dimensional cross sectional shape. The edge diverter cylinder is described in terms of the common midpoints Z of the different radius circles that define the parallel walls of its two dimensional cross sectional shape.

| wall | arc radius | angular length |
|---|---|---|
| Freeze Plug Cylinder (Ref FIGS. 7 & 18) | | |
| 50 | 3" | 89.4 degrees taken from centroid X |
| 52 | ⅜" | 30.6 degrees taken from centroid X |
| Central Diverter Cylinder (Ref FIGS. 8 & 19) | | |
| 54 | 3" radius | 89.4 degrees taken from circumcenter Y of circumscribing circle |
| 56 | 3 & ⅜" radius | 105.6 degrees taken from circumcenter Y of circumscribing circle |
| 52 | ⅜" radius | 30.6 degrees taken from circumcenter Y of circumscribing circle |
| Edge Diverter Cylinder (Ref FIGS. 9 & 20) | | |
| 58 | ⅜" radius | 2.25 degrees of arc taken from common midpoint Z* or 33 degrees of a ⅜" radius circle |
| 60 | 3" radius | 19.2 degrees scribed arc about 3" radius circle* taken from common midpoint Z |
| 62 | 3 & ⅜" radius | 23.7 degrees scribed arc about 3 & ⅜" radius circle* taken from common midpoint Z |

*Note:

60 and 62 have different arcs but reside ⅜" apart as their root circles have a common midpoint The following table represents the contour and length of each of the walls of the three cylinders as viewed in cross section and expressed in generic terms for a staggered heat exchanger design having tubes of outside diameter TOD, a spacing between the centers of adjacent tubes of CAT, and a spacing between the outside of adjacent tube walls of ATW.

| wall | arc radius | angular length |
|---|---|---|
| Freeze Plug Cylinder (Ref FIG. 7) | | |
| 50 | 3 ATW | 89.4 degrees taken from centroid |
| 52 | TOD/2 | 30.6 degrees taken from centroid |
| Central Diverter Cylinder (Ref FIG. 8) | | |
| 54 | 3 ATW | 89.4 degrees taken from circumcenter of circumscribing circle |
| 56 | (3 + TOD/2) ATW | 105.6 degrees taken from circumcenter of circumscribing circle |
| 52 | TOD/2 | 30.6 degrees taken from circumcenter of circumscribing circle |
| Edge Diverter Cylinder (Ref FIG. 9) | | |
| 58 | TOD/2 | 2.25 degrees of arc taken from common midpoint or 33 degrees of a TOD/2 radius circle |
| 60 | 3 ATW | 19.2 degrees scribed arc about 3 ATW radius circle* taken from common midpoint |
| 62 | (3 + TOD/2) ATW | 23.7 degrees scribed arc about (3 + TOD/2) ATW radius circle* taken from common midpoint |

Tube Outside Diameter (TOD)
Distance Center to Center of Adjacent Tubes (CAT)
Distance between Adjacent Tube Walls (ATW)

The following table illustrates the geometric configurations of the various elements where the tubes are ⅝ inch OD with a center to center spacing of 1.5 inches (which is a standard size.)

| wall | arc radius | angular length |
|---|---|---|
| Freeze Plug Cylinder (Ref FIG. 7) | | |
| 50 | 2⅝" radius | 89.4 degrees taken from centroid |
| 52 | 5/16" radius | 30.6 degrees taken from centroid |
| Central Diverter Cylinder (Ref FIG. 8) | | |
| 54 | 2⅝" radius | 89.4 degrees taken from circumcenter of circumscribing circle |
| 56 | 2.898" radius | 105.6 degrees taken from circumcenter of circumscribing circle |
| 52 | 5/16" radius | 30.6 degrees taken from circumcenter of circumscribing circle |
| Edge Diverter Cylinder (Ref FIG. 9) | | |
| 58 | 5/16" radius | 2.25 degrees of arc taken from common midpoint or 33 degrees of a 5/16" radius circle |
| 60 | 2⅝" radius | 19.2 degrees scribed arc about 2⅝" radius circle* taken from common midpoint |

-continued

| wall | arc radius | angular length |
|---|---|---|
| 62 | 2.898" radius | 23.7 degrees scribed arc about 2.898" radius circle* taken from common midpoint |

Tube Outside Diameter (TOD)
Distance Center to Center of Adjacent Tubes (CAT)
Distance between Adjacent Tube Walls (ATW)

The following chart reflects a staggered heat exchanger design having the dimensions for ⅝ inch tubes spaced 1.5 inches apart center to center as calculated form the previous chart. Here the outside diameter (TOD) is ⅝ inch, the spacing between the centers of adjacent tubes (CAT) is 1.5 inches, and a spacing between the outside of adjacent tube walls (ATW) is ⅞ inches.

| wall | arc radius | angular length |
|---|---|---|
| Freeze Plug Cylinder (Ref FIG. 7) | | |
| 50 | 2.635 inches | 89.4 degrees taken from centroid |
| 52 | .3125 inches | 30.6 degrees taken from centroid |
| Central Diverter Cylinder (Ref FIG. 8) | | |
| 54 | 2.625 inches | 89.4 degrees taken from circumcenter of circumscribing circle |
| 56 | 2.898 inches | 105.6 degrees taken from circumcenter of circumscribing circle |
| 52 | .3125 inches | 30.6 degrees taken from circumcenter of circumscribing circle |
| Edge Diverter Cylinder (Ref FIG. 9) | | |
| 58 | .3125 inches | 2.25 degrees of arc taken from common midpoint or 33 degrees of a TOD/2 radius circle |
| 60 | 2.625 | 19.2 degrees scribed arc about 3 ATW radius circle* taken from common midpoint |
| 62 | 2.898 inches | 23.7 degrees scribed arc about (3 + TOD/2) ATW radius circle* taken from common midpoint |

Tube Outside Diameter (TOD) = ⅝ inch
Distance Center to Center of Adjacent Tubes (CAT) = 1.5 inches
Distance between Adjacent Tube Walls (ATW) = ⅞ inches Looking at FIGS. 3 and 5 the spatial placement and organization of the cylinders can best be explained. All cylinders have a planar face 50 at either end. These planar faces 50 help seal the cylinders to the header end cap 10 and the header support plate 20. It is to be noted that complete fluid sealing is not critical to the performance of the Hx 2 although this design necessitates that the tubes extend a short distance into the air tunnel space so that the cylinders can be precisely positioned (to establish the flow paths 28 discussed herein.) These polymer cylinders have three distinct and synergistic geometrical shapes that allow a repeated pattern of placement of the three cylinders so as to form a series of heat transfer fluid paths 28 formed between the voids between the lengths of the exterior walls of the non touching cylinders within the air tunnel space 18 that replaces the U bend section that would be found in conventional tubes. These cylinders seal to the adjacent cylinder's side walls, and since they are in contact with the support wall 20 and the end cap 10, and touch the exposed lip of the tubes 30, the cylinders cannot move. To stabilize the general array and the peripheral cylinders, there are array end spacers 60 in the air tunnel space 18. These spacers 60 may be made by the injection of an expanding foam or polymer around the ends of the array prior to sealing the header with the end cap 10. Optionally there may be a mechanical attachment means placed through mounting orifice 70 and engaged onto the support wall 20.

Looking at FIGS. 16 and 17 two configurations of the alternate embodiment can be seen. Here, rather than using three cylinders to form an array that defines the fluid paths 28, a monolithic sheet 62 is used. Looking at FIG. 16 it can be seen that this sheet 62 also requires end array spacers 60 to securely position the fluid paths 28 over the tubes 30. In FIG. 17 the use of end array spacers is eliminated and interstitial voids 64 are incorporated into the sheet 62 to help with the freeze protection.

These freeze protection cylinders deform to accommodate the trapped expanding ice in the fluid paths 28, as necessary to maintain the integrity of the tubes 30. For example, the freeze plug cylinders have an internal void that allows their side walls to flex inward. After the frozen area in the fluid path thaws the cylinders flex back to their original shape, again sealing and defining each of the particular flow paths. Since these fluid paths 28 will be generally rectangular in cross section versus the round fluid path in a U bent tube, they can transfer the same volume of fluid but with a thinner profile. This allows the depth of the air tunnel space 18 to be reduced at each of the ends of the heat exchanger 2. As a secondary benefit of this freeze protection design the overall size of the heat exchanger 2 is reduced.

As a third advantage of the improved header assembly, when there is a damaged tube 30 a different shaped polymer cylinder/s may be added to the patterned array of cylinders in the air tunnel space to divert the fluid from traversing that tube 30 and yet allow the heat exchanger 2 to operate normally. This would be a simple repair as only the end caps 10 need to be removed and the new pieces inserted and the existing pieces rearranged to facilitate the repair.

It is to be noted that while there are numerous heat exchanger designs, most would benefit from the incorporation of the disclosed invention although for the purposes of this disclosure the preferred and alternate embodiments are detailed in a heat exchanger 2 with the fluid inlet 4 and fluid outlet 6 both in one supply header 8 located at a proximate end of the heat exchanger 2 and a return header 10 located at the distal end of the heat exchanger 2. (FIG. 1) Cooling tubes 12 (the coil) traverse between the headers and have fins 14 disposed thereon to conductively disperse the heat in the heat transfer media. The tubes 12 are arranged in a staggered design wherein each tube 12 is equidistant from all adjacent tubes. This staggered tube configuration is the most efficient as it allows for the tubes 12 to be placed closer together than the in-line designs and exposes the tubes to more moving air. It is this staggered tube configuration that allows for the repeated geometric pattern by the placement of only three different parts to work in the improved header assembly.

Since the array of return cylinders is substantially the same as the array of supply cylinders, only one header will be discussed. Each tube 30, other than the exterior tubes have three freeze plug cylinders 22 and three central diverter cylinders 24 alternately contacting its exterior lip 40, however only one of the smaller radius curved walls 52 of the central diverter cylinders 24 and two of the apexes 55 contact each tube 30. About one section of the exterior of each tube 30 contiguously reside two central diverter cylinders 24 separated by one freeze plug cylinder 22. About another section of the same tube 30 contiguously reside two freeze plug cylinders 22 separated by one central diverter cylinder 24. Since neither of these tri cylinder groupings touch the other there is two potential fluid paths established between two of the 6 adjacent, equidistant tubes 30. Into one of these two potential fluid paths is inserted an edge diverter cylinder 26 which matingly and completely blocks that potential fluid path. This leaves a fluid path 28 between two adjacent tubes 30. Along the edge of the entire HX header array a series of edge diverter cylinders 26 may optionally be used. These optional cylinders 65 (FIG. 3) are depicted with a different cross hatching to distinguish them from the mandatory cylinders although they are physically indistinguishable.

In the event that there is a rupture of a tube 30, its flow path 28 in both the return header and supply headers may be blocked by the insertion of another edge diverter cylinder 26 or 46 and the Hx 2 may function again with only a minimal loss of efficiency.

The major components of the preferred embodiment, the freeze plug cylinders 22 and 42, the central diverter cylinders 24 and 44 and the edge diverter cylinders 26 and 46 as well as the header channel sheet 62 of the alternate embodiments are made of a polymer. Options for this polymer include but are not limited to Polyacrylic acid (PAA), Cross-linked polyethylene (PEX or XLPE), Polyethylene (PE), Polyethylene terephthalate (PET or PETE), Polyphenyl ether (PPE), Polyvinyl chloride (PVC), Polyvinylidene chloride (PVDC), Polylactic acid (PLA), Polypropylene (PP), Polybutylene (PB), Polybutylene terephthalate (PBT), Polyamide (PA), Polyimide (PI), Polycarbonate (PC), Polytetrafluoroethylene (PTFE), Polystyrene (PS), Polyurethane (PU), Polyester (PEs), Acrylonitrile butadiene styrene (ABS), Poly(methyl methacrylate) (PMMA), Polyoxymethylene (POM), Polysulfone (PES), Styrene-acrylonitrile (SAN), Ethylene vinyl acetate (EVA), and Styrene maleic anhydride (SMA). Although there are numerous possibilities, preferably these cylinders are made of a crosslinked HDPE (high density polyethylene), commonly abbreviated PEX or XLPE. The HDPE is melted and continuously extruded into these major components. These cross-linked bonds in the HDPE polymer structure, changes the thermoplastic into an elastomer. The crosslinking of the HDPE results in a material that is more flexible and strong under temperature extremes from well below freezing to 210 degrees Fahrenheit and 150 psi, and better resists creep deformation and chemical attack. The preferred type of crosslinked HDPE would be one that meets the ASTM F 876, F 877, AWWA C904 and CSA B137.5 testing standards.

Of primary importance is the HDPE's ability to be freeze damage resistant and to expand and contract as water freezes and thaws within the channels or water paths formed by the arrangement of the freeze plugs, central and edge diverters. Of importance also is the ability to resist the scale build-up common with copper coils and not to pit or corrode when exposed to acidic water.

Although disclosed primarily with the plugs and diverters made out of a cross linked polymer able to withstand distortions accompanying freezing conditions, it is also known that this design could be made of an extruded or formed otherwise, inelastically deformable member mad of a material such as a metal. In this situation the freeze protection would be lost but the remaining advantages of size, repairability and modification would still exist.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A freeze protection system for a heat exchanger comprising:

a series of three matingly conformed hollow polygonal prisms that have different cross sectional profiles and are geometrically shaped to cooperatively interlock so that they may be spatially arranged within a heat exchanger's headers in a repeating pattern so as to form fluid paths between adjacent heat exchanger tubes;

at least one first hollow polygonal prism having six sides and a two parallel, planar end first faces;

at least one second hollow polygonal prism having four sides and two parallel planar end second faces; and at least one third hollow polygonal prism having four sides and two parallel, planar end third faces;

wherein said hollow polygonal prisms matingly conform about each other around a heat exchanger tube to form a series of fluid paths within said heat exchanger header; and wherein said first hollow polygonal prism has six first hollow polygonal prism exterior walls made up of three substantially similar first convex curved exterior walls having a first radius wherein said first convex curved exterior walls are connected by three first concave curved exterior walls having a second radius; and wherein said second hollow polygonal prism has four, second hollow polygonal prism concave curved exterior walls made of two substantially similar length second concave curved exterior walls of said first radius, connected at a first end by a longer third concave curved exterior wall having a third radius and at a second end by a fourth concave curved exterior wall of said second radius; and wherein said third hollow polygonal prism has four third hollow polygonal prism curved walls made of two substantially similar fifth convex curved exterior walls of said second radius that connect and hold parallel a short sixth concave curved exterior wall of said first radius and a longer second convex curved exterior wall of said third radius.

2. The freeze protection system of claim 1 further comprising a central orifice formed therein said first cylinder hollow polygonal prism between said planar end first faces.

3. The freeze protection system of claim 2 further comprising a central orifice formed therein said second cylinder hollow polygonal prism between said planar end first faces.

4. The freeze protection system of claim 3 further comprising:

a heat exchanger support plate; and a heat exchanger header end cap;

wherein said plate and said end cap lie in parallel planes and said hollow polygonal prisms reside between said plate and said end cap.

5. An improved heat exchanger header configuration comprising:

a series of three matingly conformed hollow polygonal prisms that may be spatially arranged within a heat exchanger's headers in a repeating pattern so as to form fluid paths between adjacent heat exchanger tubes;

at least one first hollow polygonal prism having six sides and a two parallel, planar end first faces;

at least one second hollow polygonal prism having four sides and two parallel planar end second faces; and at least one third hollow polygonal prism having four sides and two parallel, planar end third faces;

wherein said hollow polygonal prisms matingly conform about each other around a heat exchanger tube to form a series of fluid paths within said heat exchanger header; and wherein said first hollow polygonal prism has six first hollow polygonal prism exterior walls made up of three substantially similar first convex curved exterior walls having a first radius wherein said first convex curved exterior walls are connected by three first concave curved exterior walls having a second radius; and wherein said second hollow polygonal prism has four, second hollow polygonal prism concave curved exterior walls made of two substantially similar length second concave curved exterior walls of said first radius, connected at a first end by a longer third concave curved exterior wall having a third radius and at a second end by a fourth concave curved exterior wall of said second radius; and wherein said third hollow polygonal prism has four third hollow polygonal prism curved walls made of two substantially similar fifth convex curved exterior walls of said second radius that connect and hold parallel a short sixth concave curved exterior wall of said first radius and a longer second convex curved exterior wall of said third radius.

6. The improved heat exchanger header configuration of claim 5 further comprising a central orifice formed therein said first hollow polygonal prism between said planar end first faces.

7. The improved heat exchanger header configuration of claim 6 further comprising a central orifice formed therein said second hollow polygonal prism between said planar end first faces.

8. The improved heat exchanger header configuration of claim 7 further comprising:

a heat exchanger support plate; and a heat exchanger header end cap;

wherein said plate and said end cap lie in parallel planes and said hollow polygonal prisms reside between said plate and said end cap.

* * * * *